US009731402B2

(12) United States Patent
Kai

(10) Patent No.: US 9,731,402 B2
(45) Date of Patent: Aug. 15, 2017

(54) GRINDING APPARATUS

(71) Applicant: DISCO CORPORATION, Tokyo (JP)

(72) Inventor: Kenya Kai, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 14/930,922

(22) Filed: Nov. 3, 2015

(65) Prior Publication Data

US 2016/0129556 A1 May 12, 2016

(30) Foreign Application Priority Data

Nov. 6, 2014 (JP) ..... 2014-225986

(51) Int. Cl.
*B24D 5/02* (2006.01)

(52) U.S. Cl.
CPC ..... *B24D 5/02* (2013.01)

(58) Field of Classification Search
CPC .. B24B 3/54; B24B 3/543; B24B 9/16; B24B 3/52; B24B 3/58; B24B 45/00; B24B 45/006; B24B 23/02; B24B 23/028; B24B 33/081
See application file for complete search history.

(56) References Cited

U.S. PATENT DOCUMENTS 3,885,925 A * 5/1975 Tatar ..... B24B 41/002 451/273
6,179,695 B1 * 1/2001 Takahashi ..... B24B 27/0076 451/271
6,277,002 B1 * 8/2001 Leadbeater ..... B24D 7/14 451/273
7,014,540 B2 * 3/2006 Nagel ..... B24B 7/16 451/268
8,753,175 B2 * 6/2014 Chen ..... B24B 45/00 451/342
2003/0049997 A1 * 3/2003 Jeong ..... B24B 41/047 451/285

FOREIGN PATENT DOCUMENTS

JP 2014-042959 3/2014

* cited by examiner

*Primary Examiner* — Dung Van Nguyen
(74) *Attorney, Agent, or Firm* — Greer Burns & Crain Ltd.

(57) ABSTRACT

A grinding apparatus has a spindle, a first wheel mount fixed to the lower end of the spindle, and a first grinding wheel mounted on the first wheel mount. The first grinding wheel has a first base and first abrasive members arranged annularly along the outer circumference of the first base in the form of a ring. A second wheel mount inside the first wheel mount is vertically movable. A second grinding wheel is mounted on the second wheel mount in concentric relationship with the first grinding wheel. The second grinding wheel includes a second base having an outer diameter smaller than the inner diameter of the ring formed by the first abrasive members. A plurality of second abrasive members are arranged annularly along the outer circumference of the second base in the form of a ring. The second wheel mount moves forward and away from a chuck table.

5 Claims, 7 Drawing Sheets

GRINDING APPARATUS

BACKGROUND OF THE INVENTION

Field of the Invention

The present invention relates to a grinding apparatus for grinding a plate-shaped workpiece to reduce the thickness of the plate-shaped workpiece to a desired thickness.

Description of the Related Art

A grinding apparatus for grinding a plate-shaped workpiece essentially includes a chuck table for holding the plate-shaped workpiece and grinding means for grinding the plate-shaped workpiece held on the chuck table. The grinding means includes a spindle and a grinding wheel mounted on one end of the spindle. The grinding wheel includes a plurality of abrasive members arranged annularly. The grinding wheel is rotated by rotating the spindle, and the abrasive members are brought into contact with the plate-shaped workpiece to thereby grind the plate-shaped workpiece until a desired thickness is reached.

As one type of such a grinding apparatus, the grinding apparatus is composed of rough grinding means for performing rough grinding to a plate-shaped workpiece and finish grinding means for performing finish grinding to the plate-shaped workpiece rough-ground. In this type of grinding apparatus, the two pieces of grinding means are required, so that the size of the grinding apparatus is increased. To cope with this problem, there has been proposed a grinding apparatus including a rough grinding wheel and a finish grinding wheel mounted on a common spindle to perform rough grinding and finish grinding (see Japanese Patent Laid-open No. 2014-042959, for example). In this grinding apparatus, the rough grinding wheel and the finish grinding wheel larger in diameter than the rough grinding wheel are concentrically mounted on a wheel mount to thereby configure a double wheel structure. Accordingly, as compared with another structure such that the rough grinding wheel and the finish grinding wheel are arranged side by side, an increase in size of the apparatus can be prevented in this double wheel structure.

SUMMARY OF THE INVENTION

However, in this double wheel structure, the diameter of the rough grinding wheel is largely different from the diameter of the finish grinding wheel. Accordingly, the positional relation between each grinding wheel and the plate-shaped workpiece must be largely changed between the case of performing the rough grinding and the case of performing the finish grinding. That is, in performing the rough grinding, the chuck table is moved to a position below the rough grinding wheel, and the center of the plate-shaped workpiece held on the chuck table is positioned just under the outer circumferential portion of the rough grinding wheel. After performing the rough grinding, the chuck table must be largely moved so as to avoid the contact of the rough grinding wheel with the plate-shaped workpiece in performing the finish grinding, and the center of the plate-shaped workpiece must be positioned just under the outer circumferential portion of the finish grinding wheel.

It is therefore an object of the present invention to provide a grinding apparatus which can eliminate the need for largely changing the positional relation between each grinding wheel and the plate-shaped workpiece in selecting between the rough grinding and the finish grinding.

In accordance with an aspect of the present invention, there is provided a grinding apparatus including a chuck table for holding a plate-shaped workpiece; a spindle; a first wheel mount fixed to the lower end of the spindle; a first grinding wheel mounted on the first wheel mount for grinding the plate-shaped workpiece held on the chuck table, the first grinding wheel including an annular first base mounted on the lower end of the first wheel mount and a plurality of first abrasive members fixed to the lower end of the first base so as to be arranged annularly along the outer circumference of the first base in the form of a ring; a second wheel mount provided inside the first wheel mount so as to be vertically movable; a second grinding wheel mounted on the second wheel mount in concentric relationship with the first grinding wheel for grinding the plate-shaped workpiece held on the chuck table, the second grinding wheel including a second base having an outer diameter smaller than the inner diameter of the ring formed by the first abrasive members and a plurality of second abrasive members fixed to the lower end of the second base so as to be arranged annularly along the outer circumference of the second base in the form of a ring; a moving mechanism for moving the second wheel mount in opposite directions forward and away from the chuck table; a first positioning portion formed in the first wheel mount for positioning the first grinding wheel in such a manner that when the second wheel mount is moved away from the chuck table by the moving mechanism, the first abrasive members project downward from the second abrasive members; and a second positioning portion formed in the first wheel mount for positioning the second grinding wheel in such a manner that when the second wheel mount is moved toward the chuck table by the moving mechanism, the second abrasive members project downward from the first abrasive members.

Preferably, the moving mechanism includes a piston having a piston rod adapted to be moved in opposite directions toward and away from the chuck table by the supply of a fluid; a cylinder defined in the first wheel mount for surrounding the piston and guiding the movement of the piston; a first supply opening for supplying the fluid to a rod end of the cylinder; a second supply opening for supplying the fluid to a head end of the cylinder; a fluid source for supplying the fluid to the first and second supply openings; and a selector valve for selecting the supply of the fluid to either the first supply opening or the second supply opening to thereby change the moving direction of the piston.

In accordance with another aspect of the present invention, there is provided a grinding apparatus including a chuck table for holding a plate-shaped workpiece; a spindle; a spindle housing for rotatably accommodating the spindle; a first wheel mount provided so as to be vertically movable with respect to the spindle; a first grinding wheel mounted on the first wheel mount for grinding the plate-shaped workpiece held on the chuck table, the first grinding wheel including an annular first base mounted on the lower end of the first wheel mount and a plurality of first abrasive members fixed to the lower end of the first base so as to be arranged annularly along the outer circumference of the first base in the form of a ring; a second wheel mount fixed to the lower end of the spindle and provided inside the first wheel mount; a second grinding wheel mounted on the second wheel mount in concentric relationship with the first grinding wheel for grinding the plate-shaped workpiece held on the chuck table, the second grinding wheel including a second base having an outer diameter smaller than the inner diameter of the ring formed by the first abrasive members and a plurality of second abrasive members fixed to the lower end of the second base so as to be arranged annularly along the outer circumference of the second base in the form of a ring; a rotation transmitting member for transmitting the rotation of the spindle through the second wheel mount to the first wheel mount; a moving mechanism for moving the first wheel mount in opposite directions forward and away from the chuck table; a first positioning portion formed on the second wheel mount for positioning the first grinding wheel in such a manner that when the first wheel mount is moved toward the chuck table by the moving mechanism, the first abrasive members project downward from the second abrasive members; and a second positioning portion mounted on the spindle housing for positioning the second grinding wheel in such a manner that when the first wheel mount is moved away from the chuck table by the moving mechanism, the second abrasive members project downward from the first abrasive members.

Preferably, the moving mechanism includes a piston adapted to be moved in opposite directions toward and away from the chuck table by the supply of a fluid; a cylinder defined in the second wheel mount for surrounding the piston and guiding the movement of the piston, the cylinder being partitioned into a first cylinder chamber and a second cylinder chamber by the piston; a first supply opening for supplying the fluid into the first cylinder chamber; a second supply opening for supplying the fluid into the second cylinder chamber; a fluid source for supplying the fluid to the first and second supply openings; and a selector valve for selecting the supply of the fluid to either the first supply opening or the second supply opening to thereby change the moving direction of the piston.

According to the grinding apparatus of the present invention, the first grinding wheel and the second grinding wheel are concentrically mounted, and these grinding wheels are rotated by the common spindle as a rotating shaft. In the case that these grinding wheels are different in kind, different kinds of grinding can be performed by these grinding wheels without increasing the size of the apparatus.

Further, the moving direction of the piston of the moving mechanism can be changed by the selector valve according to grinding conditions, thereby selecting either the first abrasive members or the second abrasive members to perform the grinding operation. For example, in performing rough grinding and finish grinding, the center of the plate-shaped workpiece can be positioned just under the outer circumferential portion of each grinding wheel with a reduced moving distance of the chuck table. Accordingly, it is unnecessary to largely change the positional relation between each grinding wheel and the plate-shaped workpiece in selecting either the rough grinding or the finish grinding. Further, since the moving distance of the chuck table can be reduced, the apparatus can be made compact.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
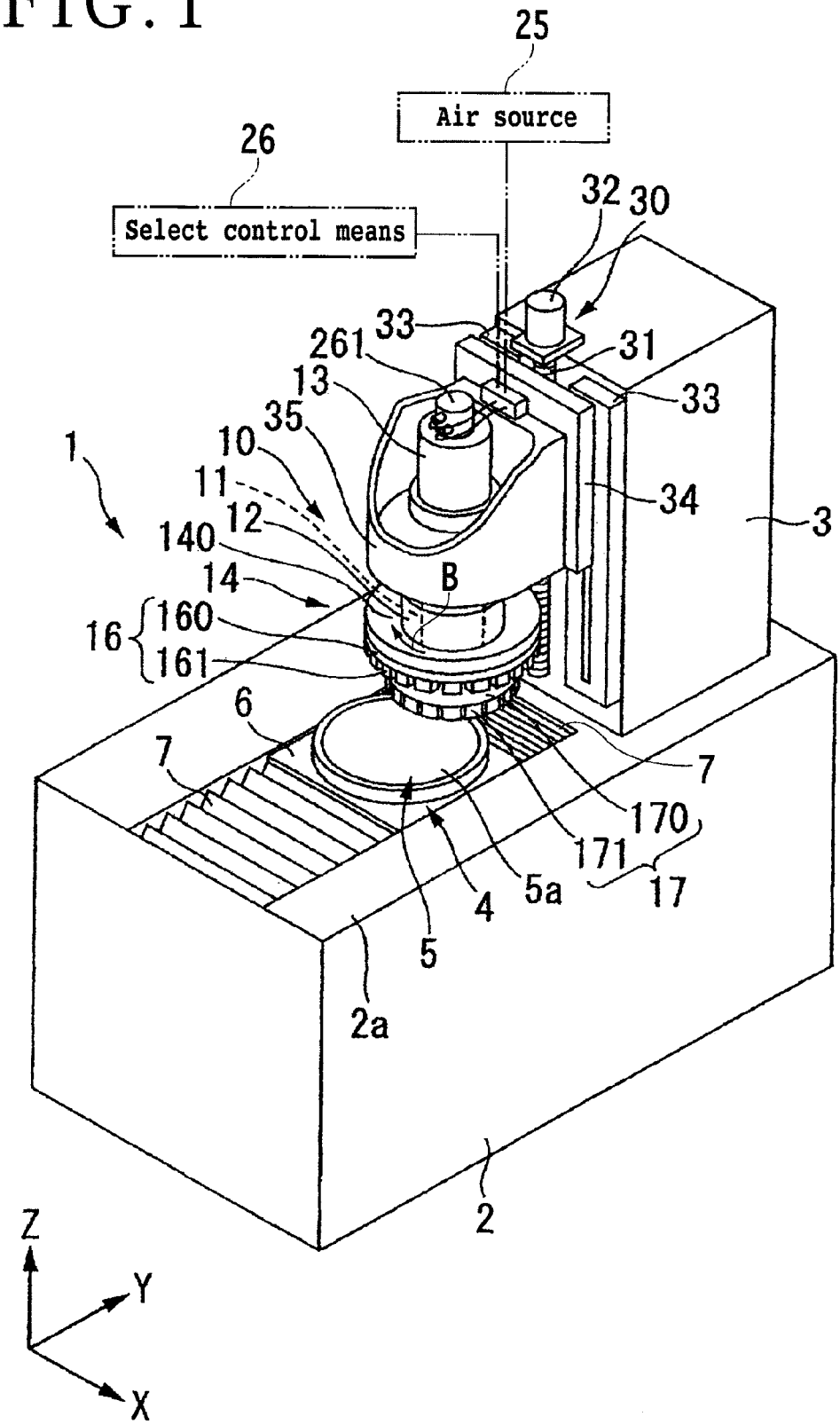
FIG. 1 is a perspective view of a grinding apparatus according to a preferred embodiment of the present invention.

Referring to FIG. 1, there is shown a grinding apparatus 1 according to a preferred embodiment of the present invention. The grinding apparatus 1 is a grinding apparatus capable of performing rough grinding and finish grinding to a workpiece. The grinding apparatus 1 has a unit base 2 extending in the Y direction. The unit base 2 has an upper surface 2*a*, on which a chuck table 4 is provided so as to be movable in the Y direction. The chuck table 4 is rotatable about its axis extending in the Z direction. The chuck table 4 includes a holding portion 5 formed of a porous material. The holding portion 5 has an upper surface as a holding surface 5*a* for holding the workpiece. The outer circumference of the chuck table 4 is surrounded by a cover 6. A pair of bellows members 7 are connected to the opposite ends of the cover 6 in the Y direction, so that the chuck table 4 can be moved in the Y direction as being accompanied by the expansion and contraction of the bellows members 7.

A column 3 is provided on the upper surface 2*a* of the unit base 2 at its rear portion in the Y direction so as to extend in the Z direction. Grinding means 10 for performing rough grinding and finish grinding to the workpiece is provided through vertically moving means 30 on the front side of the column 3 in the Y direction. The grinding means 10 includes a spindle 11 having an axis extending in the Z direction, a spindle housing 12 for rotatably supporting the spindle 11 so as to surround it, a motor 13 connected to the upper end of the spindle 11 for rotating the spindle 11, and first and second grinding wheels 16 and 17 mounted through a mount 14 to the lower end of the spindle 11 so as to be arranged in a concentric manner.

The vertically moving means 30 includes a ball screw 31 extending in the Z direction, a motor 32 connected to one end of the ball screw 31 for rotating the ball screw 31, a pair of guide rails 33 extending parallel to the ball screw 31, and a moving member 34 having an internal nut (not shown) for threadedly engaging the ball screw 31 and a pair of slide portions (not shown) formed on one side surface of the moving member 34 for slidably engaging the guide rails 33. Accordingly, in the vertically moving means 30, when the motor 32 is operated to rotate the ball screw 31, the moving member 34 is moved along the guide rails 33 in the Z direction, so that the moving member 34 is vertically moved. A holder 35 for holding the grinding means 10 is connected to the moving member 34, so that the grinding means 10 held by the holder 35 can be vertically moved by the vertical movement of the moving member 34.

The first grinding wheel 16 is composed of an annular first base 160 and a plurality of first abrasive members 161 fixed to the lower surface of the first base 160 so as to be arranged annularly in the form of a ring. The first abrasive members 161 are abrasive members for rough grinding. On the other hand, the second grinding wheel 17 is composed of a circular second base 170 having an outer diameter smaller than the inner diameter of the ring formed by the first abrasive members 161, and a plurality of second abrasive members 171 fixed to the lower surface of the second base 170 along the outer circumference thereof so as to be arranged annularly in the form of a ring. The second abrasive members 171 are abrasive members for finish grinding.

Figure 2:
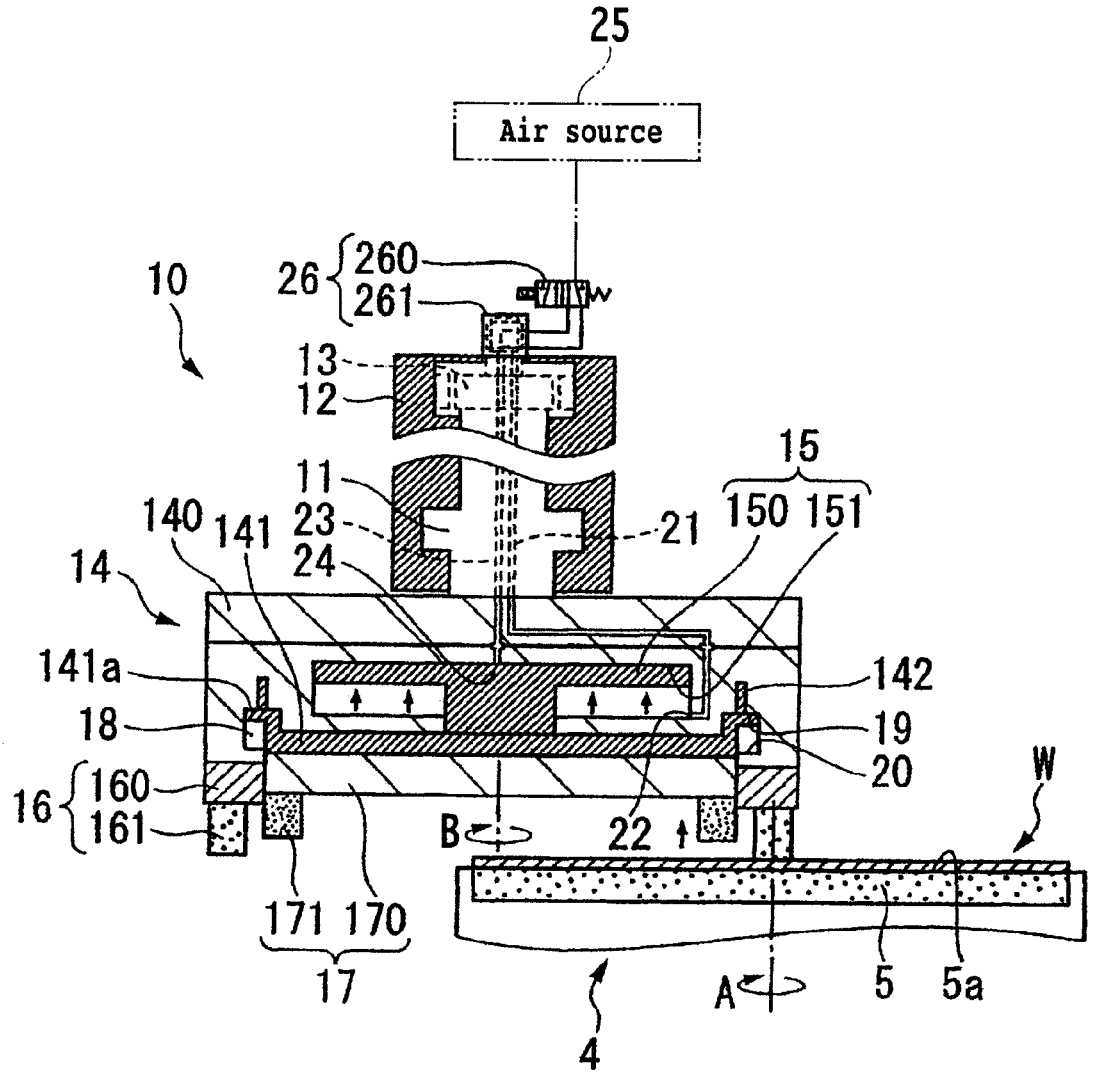
FIG. 2 is a sectional view showing a condition where a first grinding wheel is used to perform rough grinding.

As shown in FIG. 2, the mount 14 includes a first mounting member (first wheel mount) 140 for mounting the first base 160, a second mounting member (second wheel mount) 141 for mounting the second base 170, and a moving mechanism 15 for relatively moving the first mounting member 140 and the second mounting member 141 in opposite directions toward and away from the chuck table 4.

The moving mechanism 15 is provided inside the first mounting member 140 at a lower portion thereof. The moving mechanism 15 includes a piston 150 moving in opposite directions toward and away from the chuck table 4 and a cylinder 151 surrounding the piston 150 for guiding the vertical movement of the piston 150. The piston 150 has a vertically extending piston rod, and the lower end of the piston rod is exposed to the lower surface of the first mounting member 140 and connected to the second mounting member 141.

The second mounting member 141 has an abutting portion 141*a* formed at the outer circumference. The abutting portion 141*a* is composed of a vertical portion projecting upward from the upper surface of the second mounting member 141 at the outer circumference thereof and a horizontal portion projecting radially outward from the upper end of the vertical portion so as to be bent at substantially right angles. Further, a rotation transmitting member 142 is connected to the abutting portion 141*a* of the second mounting member 141. The rotation transmitting member 142 functions to transmit the rotation of the spindle 11 through the first mounting member 140 to the second mounting member 141. The rotation transmitting member 142 is configured by pins, for example. A space for accommodating the second mounting member 141 and the second grinding wheel 17 is formed in a lower portion of the first mounting member 140. The inner circumferential surface of the lower portion of the first mounting member 140 forming this space is formed with a groove 18 for slidably engaging the abutting portion 141*a*. Accordingly, the groove 18 of the first mounting member 140 functions to guide the vertical movement of the abutting portion 141*a* of the second mounting member 141.

One end (upper end) of the groove 18 is formed as a first positioning portion 19. When the abutting portion 141*a* abuts against the first positioning portion 19, the second mounting member 141 and the second grinding wheel 17 are raised. Accordingly, the first abrasive members 161 project downward from the second abrasive members 171, so that the first grinding wheel 16 can be set at a desired position. On the other hand, the other end (lower end) of the groove 18 is formed as a second positioning portion 20. When the abutting portion 141*a* abuts against the second positioning portion 20, the second mounting member 141 and the second grinding wheel 17 are lowered. Accordingly, the second abrasive members 171 project downward from the first abrasive members 161, so that the second grinding wheel 17 can be set at a desired position.

Reference numeral 25 denotes an air source for supplying air to the cylinder 151. A first air passage 21 and a second air passage 23 for making the communication between the air source 25 and the cylinder 151 are formed in the spindle 11 and the mount 14. A first supply opening 22 for supplying the air into the cylinder 151 from its lower end (rod end) is formed at one end of the first air passage 21. A second supply opening 24 for supplying the air into the cylinder 151 from its upper end (head end) is formed at one end of the second air passage 23.

There is provided select control means 26 between the air source 25 and the other ends of the first and second air passages 21 and 23. The select control means 26 functions to change the moving direction of the piston 150 in the cylinder 151. The select control means 26 includes a selector valve 260 for selecting either the first supply opening 22 or the second supply opening 24 to supply the air from either the first supply opening 22 or the second supply opening 24 and a rotary joint 261 for supplying the air to the other ends of the first and second air passages 21 and 23 formed in the spindle 11. When the select control means 26 is operated to supply the air to the first supply opening 22, the piston 150 can be moved in the cylinder 151 in the upward direction away from the chuck table 4. Conversely, when the select control means 26 is operated to supply the air to the second supply opening 24, the piston 150 can be moved in the cylinder 151 in the downward direction toward the chuck table 4.

Figure 3:
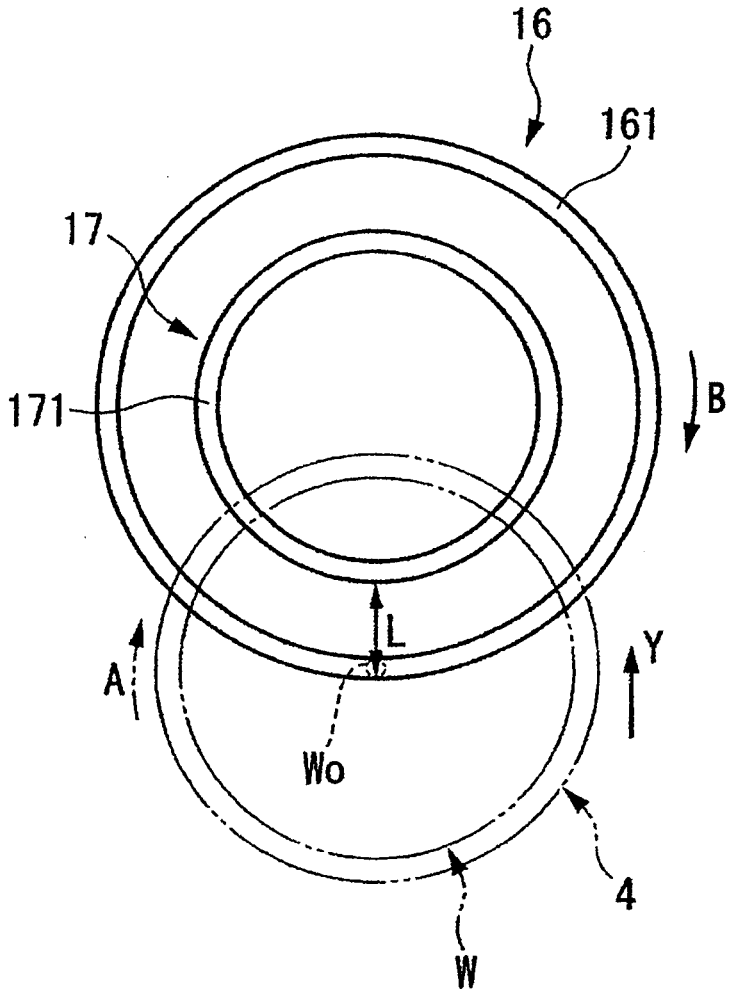
FIG. 3 is a plan view showing a condition where the center of a plate-shaped workpiece is positioned just under the path of first abrasive members constituting the first grinding wheel.

There will now be described the operation of the grinding apparatus 1 in performing rough grinding and finish grinding to a plate-shaped workpiece W shown in FIG. 2. The plate-shaped workpiece W is an example of the workpiece, and the material of the plate-shaped workpiece W is not especially limited. As shown in FIG. 2, rough grinding is performed to the plate-shaped workpiece W by using the first grinding wheel 16. In performing the rough grinding, the plate-shaped workpiece W to be ground is transferred to the holding surface 5*a* of the holding portion 5 of the chuck table 4 shown in FIG. 1. Thereafter, suction means (not shown) is operated to hold the plate-shaped workpiece W on the holding surface 5*a* under suction. As shown in FIG. 3, the chuck table 4 is next moved in the Y direction as being rotated in the direction shown by an arrow A, thereby positioning the center Wo of the plate-shaped workpiece W directly under the path of the first abrasive members 161 constituting the first grinding wheel 16.

Thereafter, the selector valve 260 of the select control means 26 shown in FIG. 2 is operated to make the communication between the air source 25 and the first supply opening 22. As a result, the air from the air source 25 is allowed to enter the first air passage 21 and supplied from the first supply opening 22 into the cylinder 151. The air supplied into the cylinder 151 from the first supply opening 22 operates to move the piston 150 in the upward direction away from the chuck table 4. By the upward movement of the piston 150, the second mounting member 141 is raised until the abutting portion 141*a* abuts against the first positioning portion 19. Accordingly, the first abrasive members 161 project downward from the second abrasive members 171, thereby setting the first grinding wheel 16 at a predetermined position where rough grinding can be performed to the plate-shaped workpiece W.

Thereafter, the spindle 11 of the grinding means 10 is rotated at a predetermined speed in the direction shown by an arrow B in FIG. 2 to thereby rotate the first grinding wheel 16, and the vertically moving means 30 shown in FIG. 1 is operated to lower the grinding means 10 in the direction toward the plate-shaped workpiece W until the first abrasive members 161 come into contact with the plate-shaped workpiece W. Accordingly, as shown in FIG. 3, the plate-shaped workpiece W is rough-ground by the first abrasive members 161 being rotated in the form of the outer ring about the axis of the spindle 11 in the condition where the first abrasive members 161 always pass directly over the center Wo of the plate-shaped workpiece W.

Figure 4:
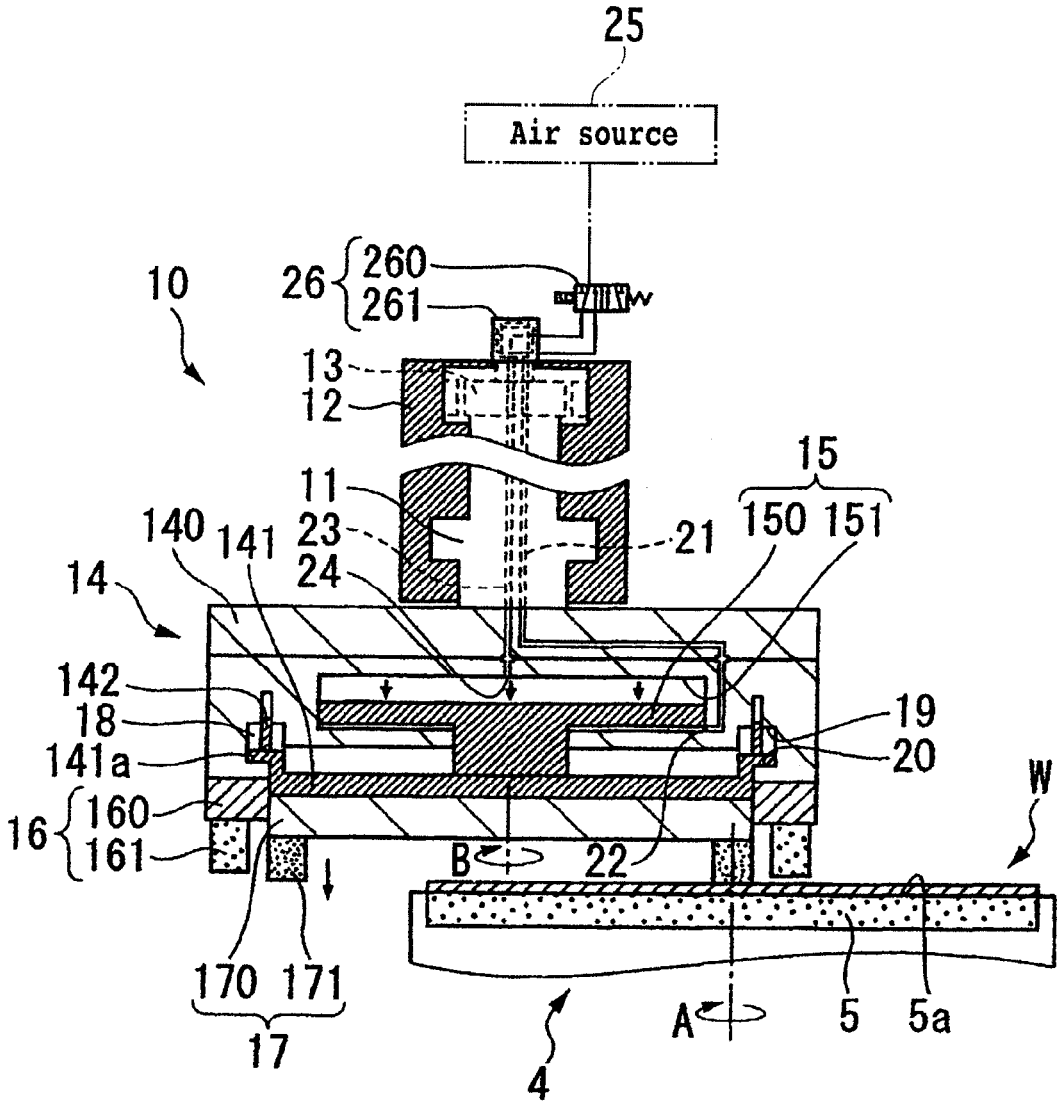
FIG. 4 is a sectional view showing a condition where a second grinding wheel is used to perform finish grinding.
Figure 5:
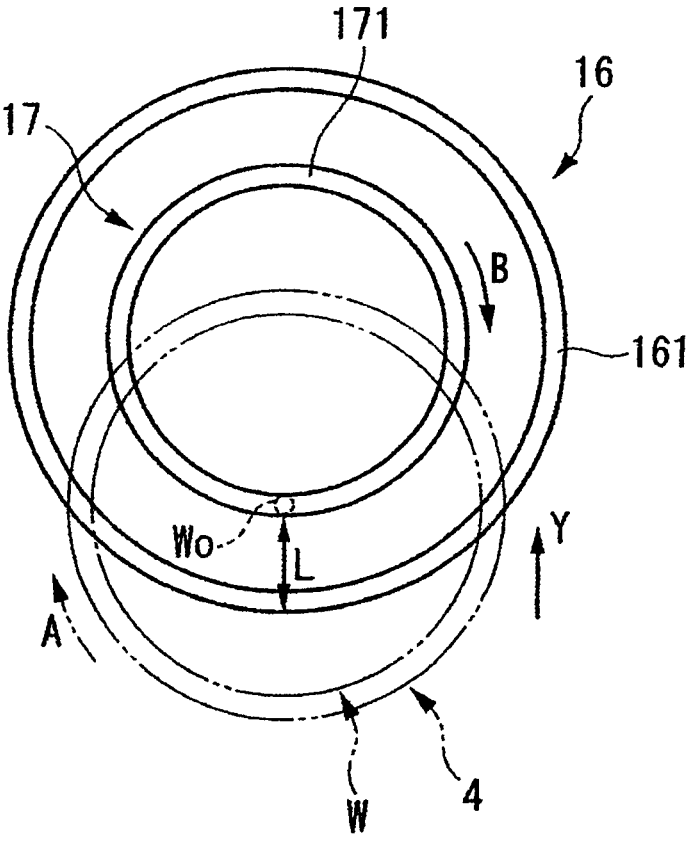
FIG. 5 is a plan view showing a condition where the center of the plate-shaped workpiece is positioned just under the path of second abrasive members constituting the second grinding wheel by moving a chuck table by a difference in radius between the first grinding wheel and the second grinding wheel concentrically mounted.

After performing the rough grinding to the plate-shaped workpiece W as mentioned above, finish grinding is performed to the plate-shaped workpiece W by using the second grinding wheel 17 as shown in FIG. 4. In performing the finish grinding, the chuck table 4 is first moved in the Y direction by a difference L between the radius of the outer circumference of the path of the first abrasive members 161 and the radius of the outer circumference of the path of the second abrasive members 171 as shown in FIG. 5 as being rotated in the direction shown by an arrow A, thereby positioning the center Wo of the plate-shaped workpiece W directly under the path of the second abrasive members 171 of the second grinding wheel 17.

While the chuck table 4 is moved in the Y direction to position the center Wo of the plate-shaped workpiece W directly under the path of the abrasive members of each grinding wheel in this preferred embodiment, the grinding means 10 may be moved in the Y direction to position the center Wo of the plate-shaped workpiece W directly under the path of the abrasive members of each grinding wheel. In other words, the chuck table 4 and the grinding wheel 10 may be relatively moved in the Y direction.

After positioning the center Wo of the plate-shaped workpiece W directly under the path of the second abrasive members 171, the selector valve 260 of the select control means 26 shown in FIG. 4 is operated to make the communication between the air source 25 and the second supply opening 24. As a result, the air from the air source 25 is allowed to enter the second air passage 23 and supplied from the second supply opening 24 into the cylinder 151. The air supplied into the cylinder 151 from the second supply opening 24 operates to move the piston 150 in the downward direction toward the chuck table 4. By the downward movement of the piston 150, the second mounting member 141 is lowered until the abutting portion 141*a* abuts against the second positioning portion 20. Accordingly, the second abrasive members 171 project downward from the first abrasive members 161, thereby setting the second grinding wheel 17 at a predetermined position where finish grinding can be performed to the plate-shaped workpiece W.

Thereafter, the spindle 11 of the grinding means 10 is rotated at a predetermined speed in the direction shown by an arrow B in FIG. 4 to thereby rotate the second grinding wheel 17 through the rotation transmitting member 142 together with the first grinding wheel 16. Further, the vertically moving means 30 shown in FIG. 1 is operated to lower the grinding means 10 in the direction toward the plate-shaped workpiece W until the second abrasive members 171 come into contact with the plate-shaped workpiece W. Accordingly, as shown in FIG. 5, the plate-shaped workpiece W is finish-ground by the second abrasive members 171 being rotated in the form of the inner ring about the axis of the spindle 11 in the condition where the second abrasive members 171 always pass directly over the center Wo of the plate-shaped workpiece W. When the thickness of the plate-shaped workpiece W is reduced to a desired thickness by the finish grinding, the grinding means 10 is raised to end the finish grinding.

As described above, the grinding means 10 included in the grinding apparatus 1 is configured in such a manner that the first grinding wheel 16 and the second grinding wheel 17 are concentrically mounted through the mount 14 to the common spindle 11, wherein the first grinding wheel 16 is configured by annularly arranging the first abrasive members 161 on the first base 160, and the second grinding wheel 17 is configured by annularly arranging the second abrasive members 171 on the second base 170 having an outer diameter smaller than the inner diameter of the ring formed by the first abrasive members 161. Accordingly, rough grinding by the first grinding wheel 16 and finish grinding by the second grinding wheel 17 can be performed efficiently to the plate-shaped workpiece W without enlarging the size of the apparatus 1.

Further, in the grinding apparatus 1, in performing the rough grinding, the select control means 26 is operated to supply air to the first supply opening 22 and thereby raise the piston 150 and the second mounting member 141, so that the first abrasive members 161 can be projected downward from the second abrasive members 171. On the other hand, in performing the finish grinding, the select control means 26 is operated to supply air to the second supply opening 24 and thereby lower the piston 150 and the second mounting member 141, so that the second abrasive members 171 can be projected downward from the first abrasive members 161. Accordingly, with a reduced moving distance of the chuck table 4 in the Y direction, the center Wo of the plate-shaped workpiece W can be positioned just under the path of the abrasive members of each grinding wheel. Further, since the moving distance of the chuck table 4 can be reduced, the apparatus 1 can be made compact.

Figure 6:
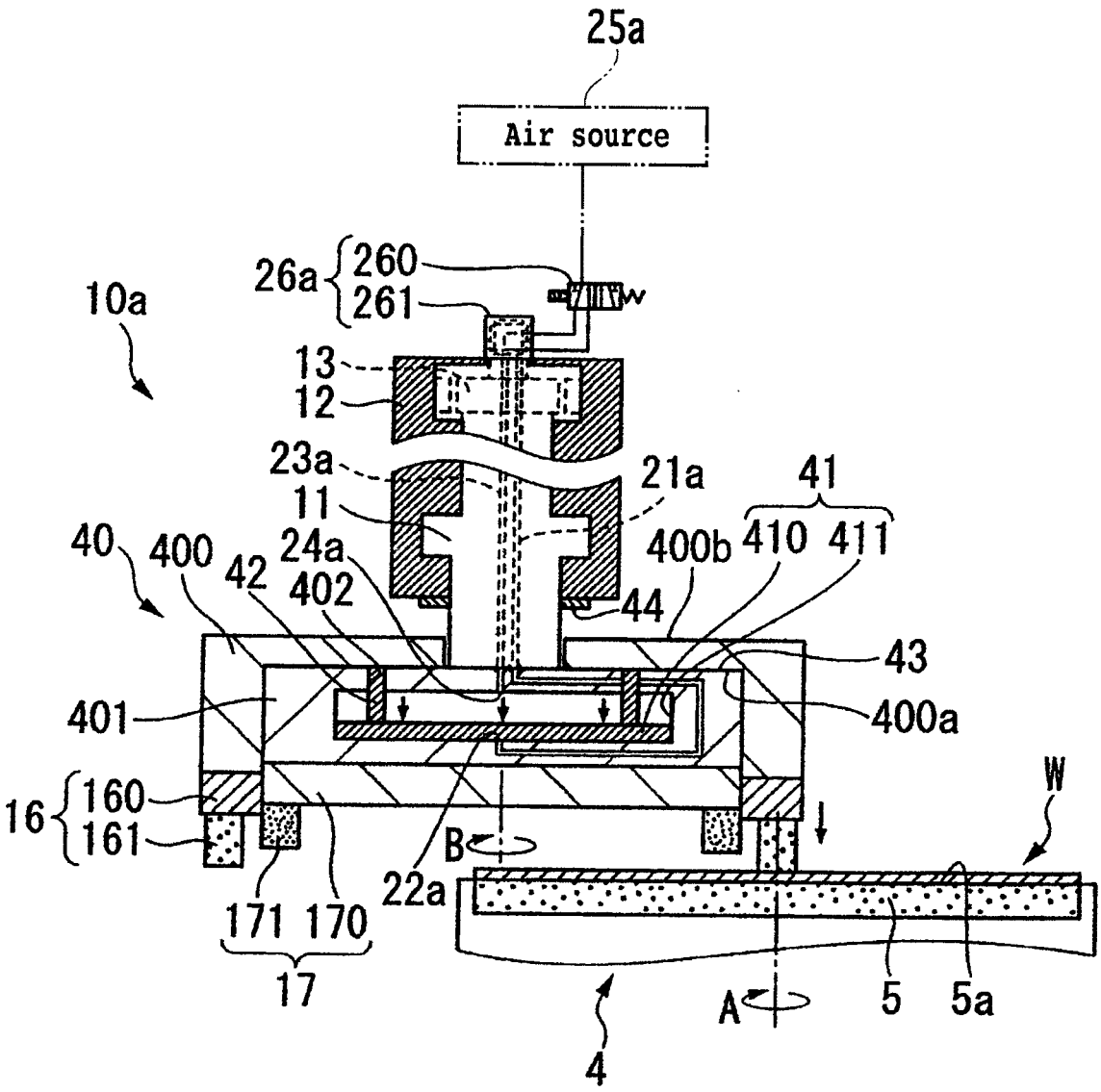
FIG. 6 is a sectional view similar to FIG. 2, showing a modification of this preferred embodiment.

Referring next to FIG. 6, there is shown grinding means 10*a* according to a modification of the above preferred embodiment. This grinding means 10*a* is so configured as to perform rough grinding and finish grinding to the workpiece, wherein the grinding means 10*a* includes a first grinding wheel 16 for rough grinding and a second grinding wheel 17 for finish grinding, and the first grinding wheel 16 is vertically movable. More specifically, the grinding means 10*a* further includes a spindle 11 and a mount 40 connected to the lower end of the spindle 11 for supporting the first grinding wheel 16 and the second grinding wheel 17. The mount 40 includes a first mounting member 400 for mounting a first base 160, a second mounting member 401 for mounting a second base 170, and a moving mechanism 41 for relatively moving the first mounting member 400 and the second mounting member 401 in opposite directions toward and away from a chuck table 4.

The second mounting member 401 has an upper surface as a first positioning portion 43. The first mounting member 400 has a lower surface 400*a* and an upper surface 400*b*. The lower surface 400*a* of the first mounting member 400 is adapted to come into contact with the first positioning portion 43 of the second mounting member 401. When the lower surface 400*a* comes into contact with the first positioning portion 43, first abrasive members 161 project downward from second abrasive members 171, thereby positioning the first grinding wheel 16. On the other hand, a second positioning portion 44 is formed (mounted) on the lower end of a spindle housing 12. The upper surface 400*b* of the first mounting member 400 is adapted to come into contact with the second positioning portion 44 of the spindle housing 12. When the upper surface 400*b* comes into contact with the second positioning portion 44, the second abrasive members 171 project downward from the first abrasive members 161, thereby positioning the second grinding wheel 17.

The moving mechanism 41 is provided inside the second mounting member 401. The moving mechanism 41 includes a piston 410 adapted to be moved in opposite directions toward and away from the chuck table 4 by the air supplied from an air source 25*a* and a cylinder 411 surrounding the piston 410 for guiding the vertical movement of the piston 410. The cylinder 411 is partitioned by the piston 410 to define a first cylinder chamber (lower chamber) and a second cylinder chamber (upper chamber). A rotation transmitting member 42 (e.g., pins) is connected at one end thereof to the piston 410 and connected at the other end to the first mounting member 400. The rotation transmitting member 42 functions to transmit the rotation of the spindle 11 through the second mounting member 401 to the first mounting member 400. The rotation transmitting member 42 is movably inserted through a through hole 402 formed in the second mounting member 401. By the vertical movement of the piston 410 in the cylinder 411, the rotation transmitting member 42 is moved through the through hole 402 to vertically move the first mounting member 400 and the first grinding wheel 16.

A first air passage 21*a* and a second air passage 23*a* for making the communication between the air source 25*a* and the cylinder 411 are formed in the spindle 11 and the mount 40. A first supply opening 22*a* for supplying the air into the cylinder 411 (first cylinder chamber) from its lower end is formed at one end of the first air passage 21*a*. A second supply opening 24*a* for supplying the air into the cylinder 411 (second cylinder chamber) from its upper end is formed at one end of the second air passage 23*a*. As similar to the grinding means 10, there is provided select control means 26*a* between the air source 25*a* and the other ends of the first and second air passages 21*a* and 23*a*. The select control means 26*a* functions to change the moving direction of the piston 410 in the cylinder 411.

In performing rough grinding to the plate-shaped workpiece W by using the first grinding wheel 16 as shown in FIG. 6, the chuck table 4 is moved in the Y direction to position the center Wo of the plate-shaped workpiece W directly under the path of the first abrasive members 161. Thereafter, the selector valve 260 of the select control means 26*a* is operated to make the communication between the air source 25*a* and the second supply opening 24*a*. As a result, the air from the air source 25*a* is allowed to enter the second air passage 23*a* and supplied from the second supply opening 24*a* into the cylinder 411 (second cylinder chamber). The air supplied into the cylinder 411 (second cylinder chamber) operates to move the piston 410 in the downward direction toward the chuck table 4. By the downward movement of the piston 410, the first mounting member 400 with the rotation transmitting member 42 is lowered until the lower surface 400*a* of the first mounting member 400 comes into contact with the first positioning portion 43. Accordingly, the first abrasive members 161 project downward from the second abrasive members 171, thereby setting the first grinding wheel 16 at a predetermined position where rough grinding can be performed to the plate-shaped workpiece W. Thereafter, the grinding means 10*a* is operated similarly to the grinding means 10 to perform the rough grinding to the plate-shaped workpiece W by using the first grinding wheel 16.

Figure 7:
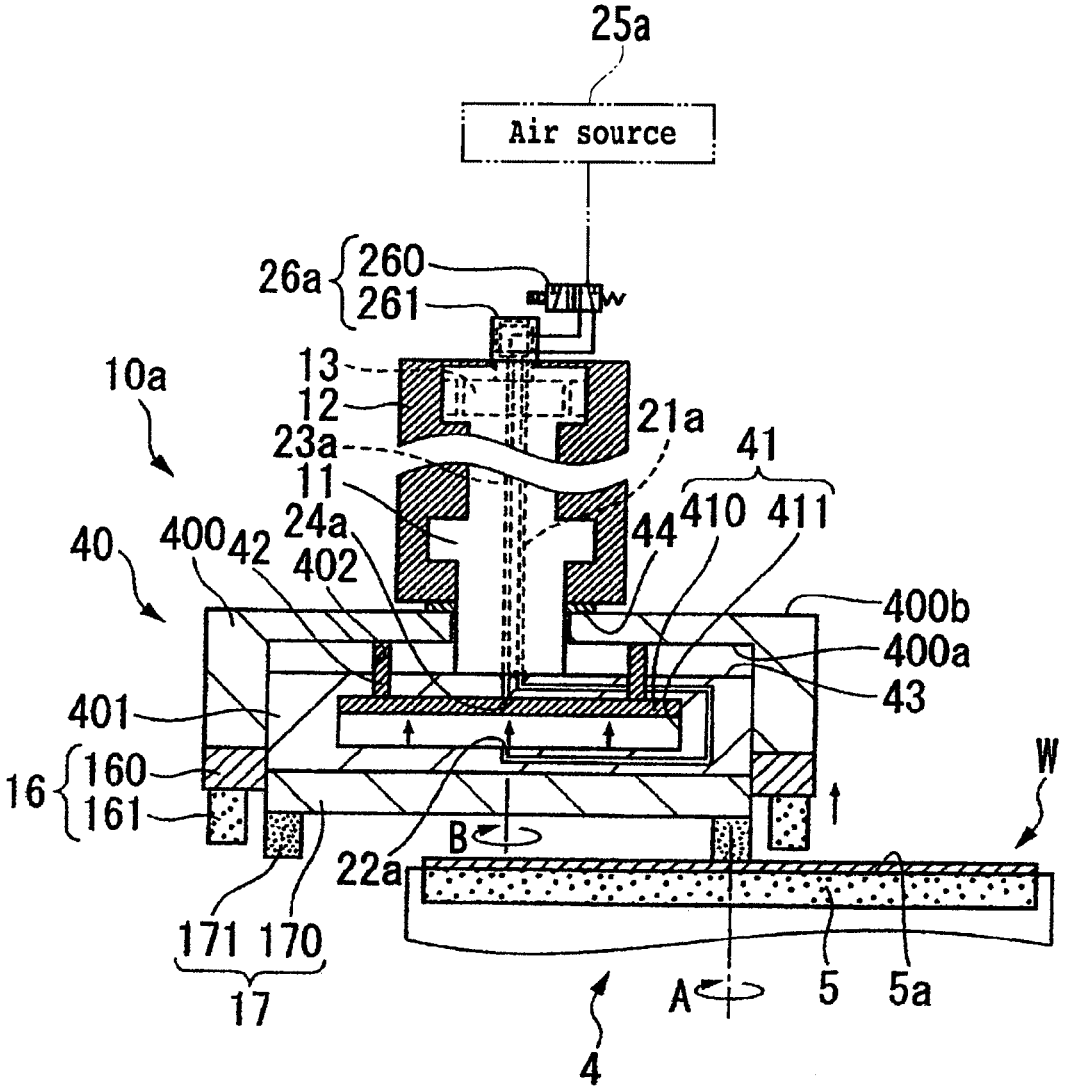
FIG. 7 is a sectional view similar to FIG. 4, showing this modification.

After performing the rough grinding to the plate-shaped workpiece W as mentioned above, finish grinding is performed to the plate-shaped workpiece W by using the second grinding wheel 17 as shown in FIG. 7. In performing the finish grinding, the chuck table 4 is first moved in the Y direction by the difference L mentioned above with reference to FIG. 5, thereby positioning the center Wo of the plate-shaped workpiece W directly under the path of the second abrasive members 171 of the second grinding wheel 17.

Thereafter, the selector valve 260 of the select control means 26*a* is operated to make the communication between the air source 25*a* and the first supply opening 22*a*. As a result, the air from the air source 25*a* is allowed to enter the first air passage 21*a* and supplied from the first supply opening 22*a* into the cylinder 411 (first cylinder chamber). The air supplied into the cylinder 411 (first cylinder chamber) from the first supply opening 22*a* operates to move the piston 410 in the upward direction away from the chuck table 4. By the upward movement of the piston 410, the first mounting member 400 with the rotation transmitting member 42 is raised until the upper surface 400*b* of the first mounting member 400 comes into contact with the second positioning portion 44. Accordingly, the second abrasive members 171 project downward from the first abrasive members 161, thereby setting the second grinding wheel 17 at a predetermined position where finish grinding can be performed to the plate-shaped workpiece W. Thereafter, the grinding means 10*a* is operated similarly to the grinding means 10 to perform the finish grinding to the plate-shaped workpiece W by using the second grinding wheel 17.

While the first grinding wheel 16 for rough grinding is concentrically provided outside the second grinding wheel 17 for finish grinding in the grinding means 10 or 10*a*, the configuration is not limited to the above. For example, the second grinding wheel 17 for finish grinding may have a diameter larger than that of the first grinding wheel 16 for rough grinding, and the second grinding wheel 17 may be concentrically provided outside the first grinding wheel 16. Further, two grinding wheels of the same kind may be concentrically provided.

Further, the first grinding wheel 16 is mounted on the first mounting member 140 or 400, and the second grinding wheel 17 is mounted on the second mounting member 141 or 401. Accordingly, in the case that the first abrasive members 161 or the second abrasive members 171 are worn, the first grinding wheel 16 or the second grinding wheel 17 can be separately exchanged.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding apparatus comprising:

a chuck table for holding a plate-shaped workpiece;

a spindle;

a first wheel mount fixed to a lower end of said spindle;

a first grinding wheel mounted on said first wheel mount for grinding said plate-shaped workpiece held on said chuck table, said first grinding wheel including an annular first base mounted on a lower end of said first wheel mount and a plurality of first abrasive members fixed to a lower end of said first base so as to be arranged annularly along the outer circumference of said first base in the form of a ring;

a second wheel mount provided inside said first wheel mount so as to be vertically movable;

a second grinding wheel mounted on said second wheel mount in concentric relationship with said first grinding wheel for grinding said plate-shaped workpiece held on said chuck table, said second grinding wheel including a second base having an outer diameter smaller than an inner diameter of the ring formed by said first abrasive members and a plurality of second abrasive members fixed to a lower end of said second base so as to be arranged annularly along the outer circumference of said second base in the form of a ring;

a moving mechanism for moving said second wheel mount in opposite directions forward and away from said chuck table;

a first positioning portion formed in said first wheel mount for positioning said first grinding wheel in such a manner that when said second wheel mount is moved away from said chuck table by said moving mechanism, said first abrasive members project downward from said second abrasive members; and a second positioning portion formed in said first wheel mount for positioning said second grinding wheel in such a manner that when said second wheel mount is moved toward said chuck table by said moving mechanism, said second abrasive members project downward from said first abrasive members, wherein said moving mechanism includes:

a piston having a piston rod adapted to be moved in opposite directions toward and away from said chuck table by the supply of a fluid;

a cylinder defined in said first wheel mount for surrounding said piston and guiding the movement of said piston;

a first supply opening for supplying said fluid to a rod end of said cylinder;

a second supply opening for supplying said fluid to a head end of said cylinder;

a fluid source for supplying said fluid to said first and second supply openings; and a selector valve for selecting the supply of said fluid from said fluid source to either said first supply opening or said second supply opening to thereby change the moving direction of said piston.

2. The grinding apparatus according to claim 1, wherein said second wheel mount is connected to said piston rod.

3. A grinding apparatus comprising:

a chuck table for holding a plate-shaped workpiece;

a spindle;

a spindle housing for rotatably accommodating said spindle;

a first wheel mount provided so as to be vertically movable with respect to said spindle;

a first grinding wheel mounted on said first wheel mount for grinding said plate-shaped workpiece held on said chuck table, said first grinding wheel including an annular first base mounted on a lower end of said first wheel mount and a plurality of first abrasive members fixed to a lower end of said first base so as to be arranged annularly along the outer circumference of said first base in the form of a ring;

a second wheel mount fixed to a lower end of said spindle and provided inside said first wheel mount;

a second grinding wheel mounted on said second wheel mount in concentric relationship with said first grinding wheel for grinding said plate-shaped workpiece held on said chuck table, said second grinding wheel including a second base having an outer diameter smaller than an inner diameter of the ring formed by said first abrasive members and a plurality of second abrasive members fixed to a lower end of said second base so as to be arranged annularly along the outer circumference of said second base in the form of a ring;

a rotation transmitting member for transmitting the rotation of said spindle through said second wheel mount to said first wheel mount;

a moving mechanism for moving said first wheel mount in opposite directions forward and away from said chuck table;

a first positioning portion formed on said second wheel mount for positioning said first grinding wheel in such a manner that when said first wheel mount is moved toward said chuck table by said moving mechanism, said first abrasive members project downward from said second abrasive members; and a second positioning portion mounted on said spindle housing for positioning said second grinding wheel in such a manner that when said first wheel mount is moved away from said chuck table by said moving mechanism, said second abrasive members project downward from said first abrasive members.

4. The grinding apparatus according to claim 3, wherein said moving mechanism includes:

a piston adapted to be moved in opposite directions toward and away from said chuck table by the supply of a fluid;

a cylinder defined in said second wheel mount for surrounding said piston and guiding the movement of said piston, said cylinder being partitioned into a first cylinder chamber and a second cylinder chamber by said piston;

a first supply opening for supplying said fluid into said first cylinder chamber;

a second supply opening for supplying said fluid into said second cylinder chamber;

a fluid source for supplying said fluid to said first and second supply openings; and a selector valve for selecting the supply of said fluid from said fluid source to either said first supply opening or said second supply opening to thereby change the moving direction of said piston.

5. The grinding apparatus according to claim 4, wherein said rotation transmitting member includes a pin having one end fixed to said piston and the other end fixed to said first wheel mount.

* * * * *